US006179020B1

(12) United States Patent
Hutchinson

(10) Patent No.: US 6,179,020 B1
(45) Date of Patent: Jan. 30, 2001

(54) FLUID LEVEL CONTROLLED AUTOMATIC SHUTOFF VALVE

(76) Inventor: Peter Hutchinson, 2150 Upper Ridge Rd., Green Lane, PA (US) 18054

( * ) Notice: Under 35 U.S.C. 154(b), the term of this patent shall be extended for 0 days.

(21) Appl. No.: 09/482,412

(22) Filed: Jan. 13, 2000

(51) Int. Cl.[7] ..... B65B 1/04
(52) U.S. Cl. ..... 141/206; 141/198; 137/484.2; 137/500

(58) Field of Search ..... 137/484.2, 484.6, 137/500; 141/95, 198, 206, 214, 215, 392

*Primary Examiner*—Steven O. Douglas
(74) *Attorney, Agent, or Firm*—Jack Lo

(57) ABSTRACT

The present fluid level controlled automatic shutoff valve is comprised of a tubular housing with an axial bore which has an upstream closure, a downstream opening, and an annular piston seat at the downstream opening. A movable piston is positioned in the bore, and biased to a retracted position by a tension spring connected between the piston and the closure of the bore. A plurality of channels on the wall of the housing extend between an upstream end of the housing and the bore. The channels terminate in venturis downstream of the piston in the retracted position. The shutoff valve is positioned in a fluid dispensing device. When pressurized fluid is delivered through the dispensing device, the fluid is directed through the channels and out the venturis at high speed and low pressure. Before the fluid level in a container being filled reaches an open lower end of the dispensing device, the pressures between the upstream and downstream ends of the piston are balanced by air flowing into downstream opening of the bore from the open lower end of the dispensing device. When the fluid level reaches the open lower end of the dispensing device, the air flow is cut off, and the low pressure fluid from the venturis pulls the piston into the seat at the downstream opening of the bore. Fluid flow is shut off.

3 Claims, 3 Drawing Sheets

FLUID LEVEL CONTROLLED AUTOMATIC SHUTOFF VALVE

BACKGROUND OF THE INVENTION

1. Field of the Invention

This invention relates generally to automatic shutoff valves controlled by the fluid level in a container.

2. Prior Art

When filling a container with a fluid dispensing device, such as a water gun, an operator must closely monitor the fluid level. The valve on the dispensing device, such as a trigger, must be manually kept open for a prolonged period, and manually closed when the desired fluid level is reached. This method is time consuming when filling a large container, and tedious when repeatedly filling multiple containers.

Numerous automatic shutoff valves are known for shutting off flow when a predetermined fluid level is reached in a container being filled. They are particularly useful for automatically filling the cells of a lead-acid battery to a predetermined level. However, they are relatively complicated and expensive to produce.

A simpler automatic shutoff valve is shown in U.S. Pat. No. 4,556,093 to Jones, and is arranged inside a dispensing device. It includes a movable tube connected to the downstream end of a constricted venturi, which directs a jet of fluid along the inside wall of the tube. A ball positioned upstream of the venturi is connected to the movable tube by a wire. The ball is kept away from the venturi by a spring. The venturi causes fluid flowing there through to substantially increase in velocity and decrease in pressure relative to the liquid at the upstream end thereof. Before the fluid level in the container reaches the lower end of the dispensing device, the pressures between the upstream and downstream ends of the venturi are equalized by outside air flowing into the movable tube from the lower end of the dispensing device. When the fluid level in the container reaches the lower end of the dispensing device, air can no longer enter the movable tube to equalize the pressure. The low pressure of the fluid jet draws the movable tube away from the venturi. The spring loaded ball is pulled against the venturi, and fluid flow is shut off. However, the movable tube cannot slide smoothly because it is only guided at the upstream end by the venturi. The downstream end would wobble in the jet and cause the upstream end to stick to the venturi. The valve is relatively long, so that it can fit a limited variety of dispensing devices. Also, the single venturi limits flow rate to a relatively low level.

OBJECTS OF THE INVENTION

Accordingly, objects of the present automatic shutoff valve are:

to be compact and easily installed in a variety of fluid dispensing devices;

to remain open when the fluid level in a container being filled is below a predetermined level;

to automatically close and shut off the dispensing device when the fluid level reaches the predetermined level;

to operate smoothly and reliably; and to be very simple to produce.

Further objects of the present invention will become apparent from a consideration of the drawings and ensuing description.

BRIEF SUMMARY OF THE INVENTION

The present fluid level controlled automatic shutoff valve is comprised of a tubular housing with an axial bore which has an upstream closure, a downstream opening, and an annular piston seat at the downstream opening. A movable piston is positioned in the bore, and biased to a retracted position by a tension spring connected between the piston and the closure of the bore. A plurality of channels on the wall of the housing extend between an upstream end of the housing and the bore. The channels terminate in venturis downstream of the piston in the retracted position. The shutoff valve is positioned in a fluid dispensing device. When pressurized fluid is delivered through the dispensing device, the fluid is directed through the channels and out the venturis at high speed and low pressure. Before the fluid level in a container being filled reaches an open lower end of the dispensing device, the pressures between the upstream and downstream ends of the piston are balanced by air flowing into downstream opening of the bore from the open lower end of the dispensing device. When the fluid level reaches the open lower end of the dispensing device, the air flow is cut off, and the low pressure fluid from the venturis pulls the piston into the seat at the downstream opening of the bore. Fluid flow is shut off.

Figure 1:
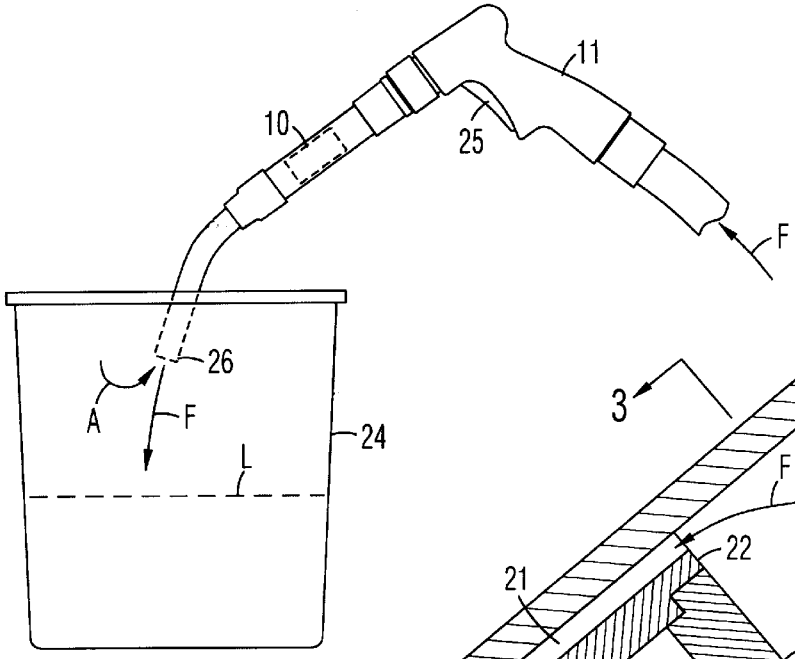
FIG. 1 is a side view of the present automatic shutoff valve installed in a fluid dispensing device, which is filling a container to an initial level.

| DRAWING REFERENCE NUMERALS | |
|---|---|
| 10. Automatic Shutoff Valve | 11. Fluid Dispensing Device |
| 12. Bore | 13. Upstream Closure |
| 14. Downstream Opening | 15. Valve Seat |
| 16. Piston | 17. Spring |
| 18. Drain Hole | 19. Upstream End |
| 20. Downstream End | 21. Channels |
| 22. Upstream End | 23. Venturis |
| 24. Container | 25. Trigger |
| 26. Open Lower End | 30. Housing |

DETAILED DESCRIPTION OF THE INVENTION

FIGS. 1–3:

A preferred embodiment of the present fluid level controlled automatic shutoff valve 10 is shown in FIG. 1 installed in-line in a fluid dispensing device 11.

Figure 2:
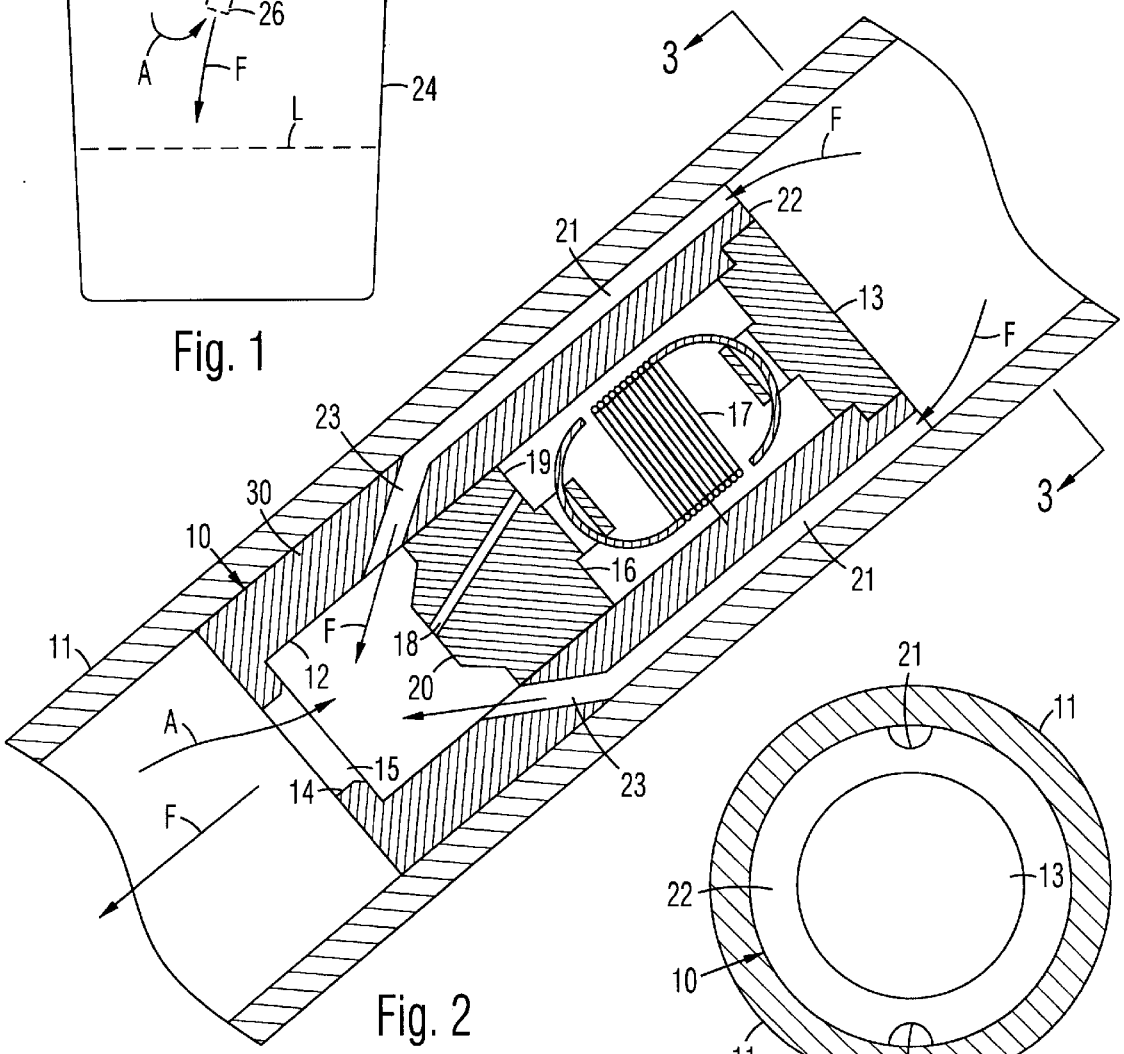
FIG. 2 is a side sectional view of the shutoff valve, taken along a vertical plane along an axis of the dispensing device, when a fluid level in the container is as shown in FIG. 1.
Figure 3:
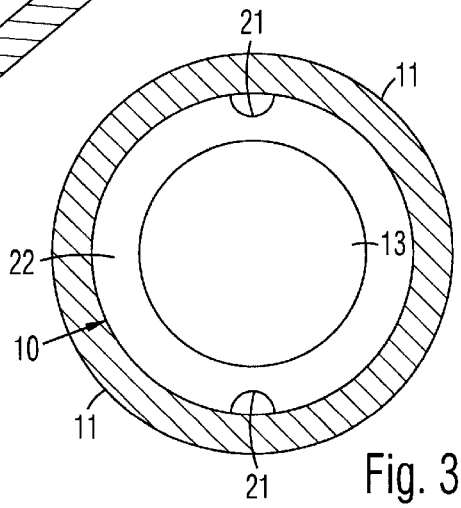
FIG. 3 is an end sectional view of the shutoff valve, taken along line 3—3in FIG. 1.

As shown in FIG. 2, shutoff valve 10 is comprised of a compact tubular housing 30 with an axial bore 12 which has an upstream closure 13, a downstream opening 14, and an annular piston seat 15 at downstream opening 14. A movable piston 16 is positioned in bore 12, and biased to a retracted position by a tension spring 17 connected between piston 16 and upstream closure 13. A small drain hole 18 extends between an upstream end 19 and a downstream end 20 of piston 16. A plurality of channels 21 extend longitudinally along an outer wall of housing 30 from an upstream end 22 of housing 30. Channels 21 terminate in venturis 23 downstream of retracted piston 16. Venturis 23 are angled inwardly into bore 12. Channels 21 are also shown in an end sectional view of shutoff valve 10 in FIG. 3. Alternatively, more or fewer channels 21 and venturis 23 may be provided.

In FIG. 1, a pressurized fluid F is delivered through dispensing device 11 into a container 24 by manually operating a valve or trigger 25 thereon. Container 24 has a fluid level L in FIG. 1. FIG. 2 shows the state of shutoff valve 10 corresponding to fluid level L in FIG. 1. Fluid F is directed at high speed and low pressure through venturis 23 into bore 12 downstream of piston 16, and out of downstream opening 14. Before fluid level L in container 24 reaches an open lower end 26 of dispensing device 11, the pressures between the upstream and downstream ends of piston 16 are balanced by air A flowing into downstream opening 14 of bore 12 from open lower end 26 of dispensing device 11. Piston 16 is kept in the retracted position by spring 17.

Figure 4:
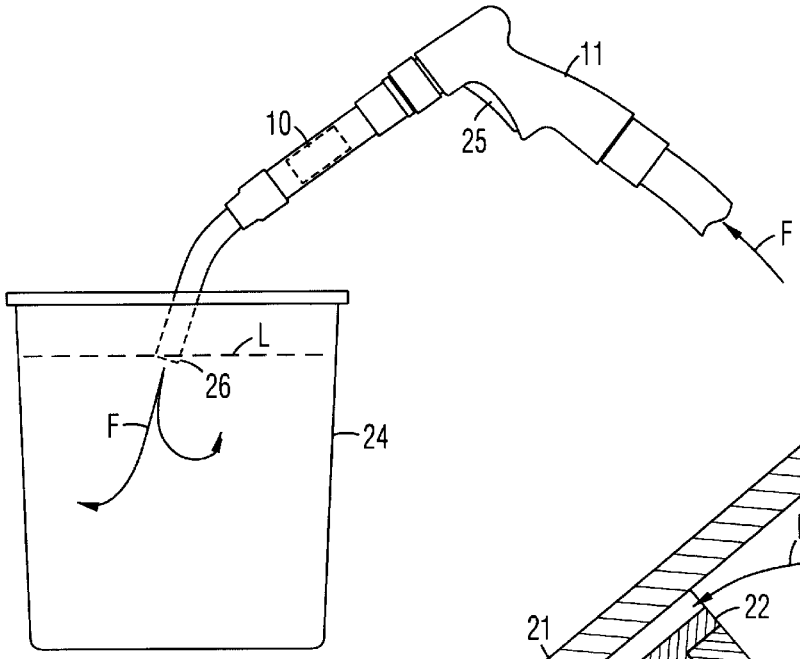
FIG. 4 is a side view of the fluid dispensing device and the container when the fluid level reaches a lower end of the dispensing device.
Figure 5:
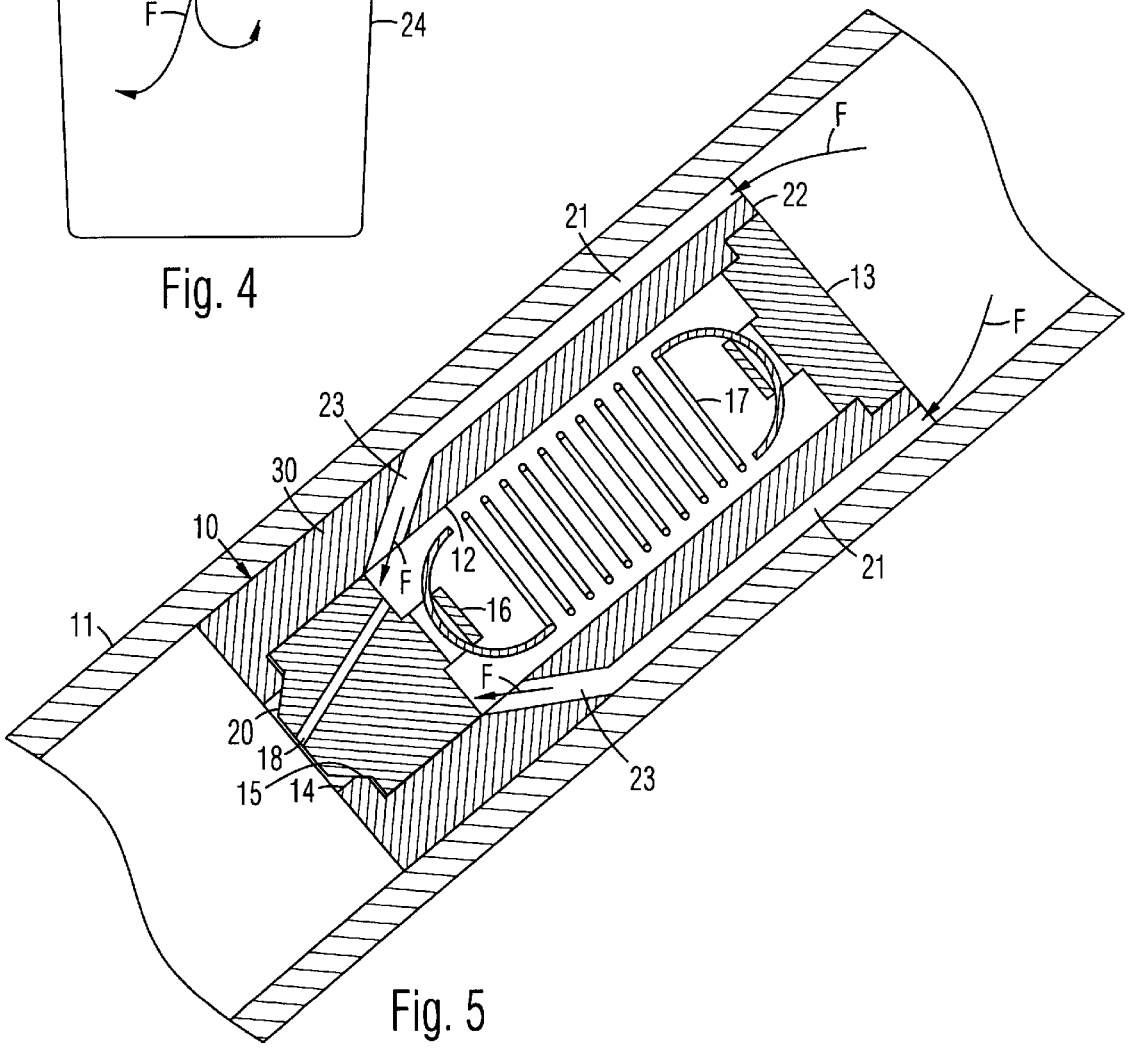
FIG. 5 is a side sectional view of the shutoff valve when the fluid level in the container is as shown in FIG. 4, and the shutoff valve is closed.

FIGS. 4–5:

In FIG. 4, when fluid level L reaches open lower end 26 of dispensing device 11, air flow into open lower end 26 is cut off. FIG. 5 shows the state of shutoff valve 10 corresponding to fluid level L in FIG. 4. In FIG. 5, the pressure at downstream end 20 of piston 16 is no longer balanced by outside air. The high speed, low pressure fluid F from venturis 23 pulls piston 16 into seat 15 at downstream opening 14 of bore 12 to shut off fluid flow and stop fluid level L at a predetermined point. Valve or trigger 25 is released to shut off dispensing device 11. Fluid F remaining in bore 12 is drained through drain hole 18 in piston 16.

Figure 6:
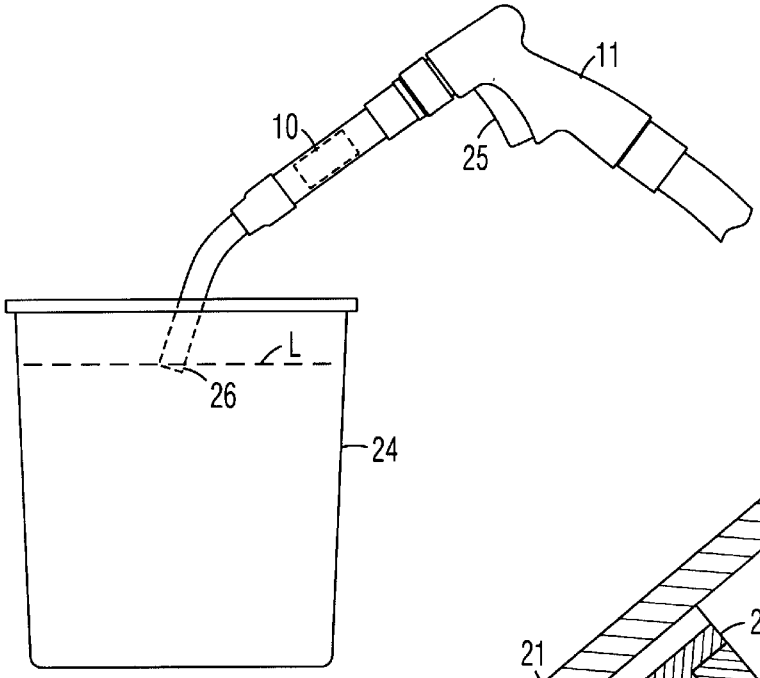
FIG. 6 is a side view of the fluid dispensing device when a trigger thereof is released.
Figure 7:
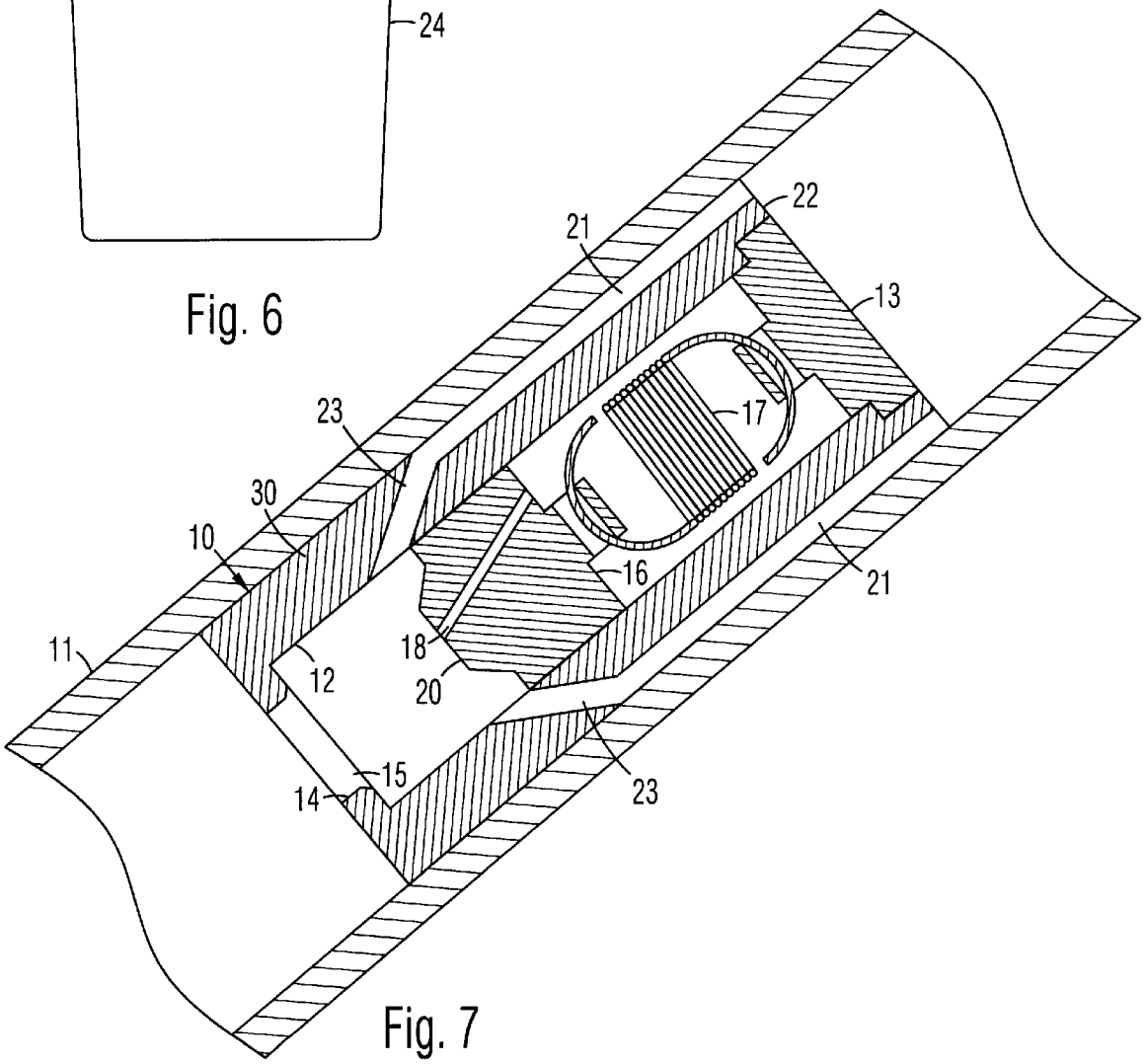
FIG. 7 is a side sectional view of the shutoff valve returning to an open position after the trigger on the fluid dispensing device is released.

FIGS. 6–7:

In FIG. 6, valve or trigger 25 is released and dispensing device 11 is shut off. When enough fluid is drained through drain hole 18 and fluid pressure upstream of piston 16 is relieved, piston 16 is biased by spring 17 back into the retraced position, as shown in FIG. 7. Dispensing device 11 is ready to be used again for filling another container.

SUMMARY AND SCOPE

Accordingly, the present automatic shutoff valve is compact and easily installed in a variety of fluid dispensing devices. It remains open when the fluid level in a container is below a predetermined level. It automatically closes and shuts off the dispensing device when the fluid level reaches the predetermined level in the container. It operates smoothly and reliably. It is also very simple to produce.

Although the above description is specific, it should not be considered as a limitation on the scope of the invention, but only as an example of the preferred embodiment. Many variations are possible within the teachings of the invention. For example, several shutoff valves can be connected in parallel for filling multiple containers simultaneously. Closure 13 may be integral to housing 30. A single channel 21 may extend completely around the outer wall of housing 30, i.e., housing 30 may have a larger diameter downstream portion and a smaller diameter upstream portion, so that the upstream portion is spaced from the interior of fluid dispensing device 11 to form an annular channel. Instead of tension spring 17, a compression spring may be positioned upstream of piston 16. Yet another type of spring may be used. Therefore, the scope of the invention should be determined by the appended claims and their legal equivalents, not by the examples given.

I claim:

1. A shutoff valve, comprising:

a tubular housing with an axial bore, an upstream end, and a downstream end, said bore including an upstream closure and a downstream opening;

a venturi connecting an outer wall of said housing and said bore, said venturi generally directed at said downstream opening of said bore;

a movable piston positioned in said bore, said piston including an upstream end and a downstream end, said piston movable between a retracted position upstream of said venturi and away from said downstream opening of said bore, and an extended position downstream of said venturi and against said downstream opening of said bore; and a spring biasing said piston to said retracted position.

2. A shutoff valve, comprising:

a tubular housing with an axial bore, an upstream end, and a downstream end, said bore including an upstream closure and a downstream opening;

a channel extending along an outer wall of said housing from said upstream end of said housing;

a venturi connecting said channel and said bore, said venturi generally directed at said downstream opening of said bore;

a movable piston positioned in said bore, said piston including an upstream end and a downstream end, said piston movable between a retracted position upstream of said venturi and away from said downstream opening of said bore, and an extended position downstream of said venturi and against said downstream opening of said bore; and a spring biasing said piston to said retracted position.

3. A shutoff valve, comprising:

a tubular housing with an axial bore, an upstream end, and a downstream end, said bore including an upstream closure, a downstream opening, and an annular piston seat at said downstream opening;

a plurality of channels extending along an outer wall of said housing from said upstream end of said housing;

a plurality of venturis connecting said channels and said bore, said venturis generally directed at said downstream opening of said bore;

a movable piston positioned in said bore, said piston including an upstream end and a downstream end, said piston movable between a retracted position upstream of said venturis and away from said piston seat, and an extended position downstream of said venturis and against said piston seat;

a tension spring connected between said piston and said upstream closure of said bore, said spring biasing said piston to said retracted position; and a drain hole extending between said upstream end and said downstream end of said piston.

* * * * *